US007934511B2

(12) United States Patent
Ehling et al.

(10) Patent No.: US 7,934,511 B2
(45) Date of Patent: May 3, 2011

(54) PROCESSING OF TOBACCO MATERIALS CONTAINING A PROPORTION OF TOBACCO FINES

(75) Inventors: Uwe Ehling, Goldkronach (DE); Matthias Link, Bayreuth (DE); Gerald Schmekel, Elmshorn (DE)

(73) Assignee: British American Tobacco (Germany) GmbH, Hamburg (DE)

( * ) Notice: Subject to any disclaimer, the term of this patent is extended or adjusted under 35 U.S.C. 154(b) by 797 days.

(21) Appl. No.: 11/883,860

(22) PCT Filed: Feb. 2, 2006

(86) PCT No.: PCT/EP2006/000908

§ 371 (c)(1),
(2), (4) Date: Nov. 7, 2007

(87) PCT Pub. No.: WO2006/084624

PCT Pub. Date: Aug. 17, 2006

(65) Prior Publication Data

US 2008/0196731 A1 Aug. 21, 2008

(30) Foreign Application Priority Data

Feb. 10, 2005 (DE) ..... 10 2005 006 117

(51) Int. Cl.
*A24B 3/14* (2006.01)

(52) U.S. Cl. ..... 131/370; 131/353; 131/371

(58) Field of Classification Search ..... 131/370, 131/353, 371, 372, 374, 375
See application file for complete search history.

(56) References Cited

U.S. PATENT DOCUMENTS

| | | | | |
|---|---|---|---|---|
| 3,076,729 | A * | 2/1963 | Garbo | 131/353 |
| 3,203,432 | A | 8/1965 | Green et al. | |
| 3,402,479 | A | 9/1968 | Hohm et al. | |
| 3,746,012 | A | 7/1973 | Deszyck | |
| 3,986,515 | A | 10/1976 | Egri | |
| 4,252,133 | A | 2/1981 | Buske et al. | |
| 4,421,126 | A * | 12/1983 | Gellatly | 131/371 |
| 4,646,764 | A | 3/1987 | Young et al. | |
| 5,722,431 | A | 3/1998 | Metzner et al. | |
| 6,840,248 | B2 | 1/2005 | Zielke | |
| 7,387,128 | B2 * | 6/2008 | Ehling et al. | 131/297 |

FOREIGN PATENT DOCUMENTS

| | | | |
|---|---|---|---|
| CN | 86107969 | A | 7/1987 |
| DE | 10065132 | A1 | 7/2002 |
| EP | 0269396 | A2 | 6/1988 |
| EP | 0845218 | A2 | 6/1998 |
| GB | 1593796 | | 7/1981 |
| RU | 2150218 | C1 | 6/2000 |
| SU | 664532 | | 5/1979 |
| SU | 720994 | | 3/1980 |
| SU | 741778 | | 6/1980 |
| WO | 03055337 | A1 | 7/2003 |

OTHER PUBLICATIONS

U.S. Patent and Trademark Office (SA/US); International Search Report; Jun. 9, 2006; pp. 1-3; U.S. Patent and Trademark Office; US.

* cited by examiner

*Primary Examiner* — Carlos Lopez

(74) *Attorney, Agent, or Firm* — Charles I. Sherman; Middleton Reutlinger

(57) ABSTRACT

The invention relates to a method of processing tobacco fines, whereby the tobacco preparation for producing smoking articles from an initial material to be processed, which contains tobacco fines and tobacco material, is subjected to an increased mechanical pressure in order to bind the tobacco fines permanently to the tobacco material, and no extra or external binding agents are added the material to be processed in order to bind the tobacco fines to the tobacco material. It further relates to smoking articles containing smoking material produced on the basis of one of the methods proposed by the invention.

25 Claims, No Drawings

PROCESSING OF TOBACCO MATERIALS CONTAINING A PROPORTION OF TOBACCO FINES

CROSS REFERENCE TO PRIOR APPLICATION

This application is a national stage filing (35 U.S.C. 371) of PCT/EP2006/000908, filed on Feb. 2, 2006, which claims priority to and benefit from German Patent Application DE 10 2005 006 117.6, filed on Feb. 10, 2005.

The present invention relates to a method of processing tobacco materials containing a high proportion of tobacco fines, in particular a method of processing tobacco dust when preparing tobacco for the production of smoking articles.

The idea of re-processing tobacco fines which occur at different points during tobacco processing (e.g. transportation, tobacco preparation, production of smoking articles) to enable them to be put to a meaningful use is already known. For example, tobacco fines may be used as one of the initial materials for tobacco reconstitution, e.g. producing tobacco film. Such processes usually enable continuous bodies of tobacco material to be produced, such as films, sheets, threads, etc.

Patent specification DE 100 65 132 A1 discloses a method of producing agglomerates. It proposes making agglomerates from the smallest tobacco particles, in particular from tobacco dust, in other words larger particle complexes which do not have to be separated out from a cigarette production machine as this is not desirable. The finest tobacco dust particles are mixed with binding agents and liquid and then sprayed out of compaction and heating chambers in order to form agglomerates, in other words the bigger units.

The disadvantage of processing the tobacco fines in this way but also more generally producing tobacco films or continuous bodies of reconstituted tobacco is the fact that the processes are very resource-intensive and binding agents have to be introduced to enable the tobacco fines to be meaningfully processed.

The objective of this invention is to propose a method of processing tobacco fines which overcomes the above disadvantages known from the prior art. In particular, processing of the tobacco fines should be of a simple and uncomplicated configuration.

This objective is achieved by the invention by a method as defined in claim 1. The dependent claims describe preferred embodiments of the invention.

As proposed by this invention, a material to be processed which contains tobacco fines and tobacco material is subjected to increased mechanical pressure and in particular also increased temperature and moisture, in order to keep the tobacco fines adhered to the tobacco material. In other words, the tobacco fines are no longer sorted and separated out for processing but are bound to form a unit with a tobacco material to enable the tobacco material with the tobacco fines bound to it to be used subsequently for the production of smoking articles. This obviates the need for expensive separate processes. The tobacco fines are simply adhered to a material or bound to the material that will be used subsequently to produce the smoking articles anyway.

As a result of this invention, there is a significant shift in size distribution towards larger particles, especially in the desired size range of 1-4 mm. This is evidenced by screening tests conducted before and after the treatments proposed by the invention.

Within the context of this description, the expression tobacco fines refers in particular to small pieces of tobacco which are actually regarded as problematic (including from a taste point of view) and are otherwise merely discharged by suction or can be used to produce reconstituted tobacco (tobacco film). In particular, tobacco fines are smaller than the cut width of tobacco (e.g. <1 mm) and more especially, tobacco fines are significantly smaller than the cut width of tobacco (e.g. <0.5 mm).

The expression "tobacco material" is basically used to describe tobacco pieces which are bigger or significantly bigger than tobacco fines, in particular tobacco pieces which are suitable for use in smoking articles or at most require further cutting for this purpose. The tobacco material may be a tobacco stem material, in particular a winnowing material, stem fibres or a tobacco leaf material as well as a mixture of these.

The tobacco material and the tobacco fines to be processed are brought to a pre-defined increased moisture content in the context of this invention. The material to be processed is also subjected to an increase in temperature, which may be obtained in particular by applying heat from outside and/or by mechanically generating pressure.

The advantages of the method proposed by the invention specifically reside in the fact that tobacco material together with tobacco fines is subjected to a mechanical pressure at an increased temperature and defined moisture level (e.g. in an extruder or a conveyor screw-conditioner). Due to the mechanical pressure, the tobacco fines are pressed onto the tobacco material and intimately bound to it. As a result of the method conditions proposed by the invention, the binding of the tobacco material with the tobacco fines is so strong that the tobacco material treated as proposed by the invention is resistant to the normal stresses which occur during cigarette production, i.e. the tobacco fines no longer drop off when being conveyed by air under normal production conditions. Mechanical stability is therefore higher than is the case with conventional tobacco film materials.

In accordance with the method, the material to be processed may contain a quantity of tobacco fines corresponding to its processing state and may even contain more than such a quantity of tobacco fines, in particular a quantity that is increased by adding tobacco fines. This being the case, not only is it possible to process tobacco fines which occur anyway, additional tobacco fines which occur at other points during production can also be processed in addition.

As a result of the invention, it is not necessary to add extra or external binding agents to bind the tobacco fines to the tobacco material: neither binding agents that are foreign to the tobacco nor inherent binding agents, i.e. which naturally occur in the tobacco. Instead, as a result of the method proposed by the invention, the tobacco fines can be bound with the tobacco material mechanically and/or by the quantities of binding agents which naturally occur in the tobacco (inherent binding agents). As a result of the method conditions proposed by the invention, such inherent binding agents (starch, resins, sugars . . . ) are activated and thus bind the tobacco fines firmly to the tobacco material. This is totally different from those methods where the addition of binding agents is absolutely essential, namely the methods of producing films or agglomerates mentioned above.

In principle, the material to be processed can be processed in batches, in particular pressed in batches, for example in a piston-cylinder unit.

The material to be processed can be pre-conditioned in preparation for the method proposed by the invention, in order to render it suitable for processing. To this end, the tobacco material is brought to one or more of the following initial conditions (figures given for pressure are always above atmospheric pressure):

| | |
|---|---|
| Temperature: | 80-147° C., preferably 100-120° C. |
| Moisture at inlet: | 6-13% |
| Moisture at outlet: | 18-35%, preferably 26-30% |
| Pressure (gas over-pressure): | 0-3 bar, preferably 0-1 bar. |

The method of processing tobacco fines proposed by the invention is preferably operated on the basis of one or more of the following parameters:

| | |
|---|---|
| Temperature: | 80-180° C., preferably 140-160° C. |
| Moisture at inlet: | 18-35%, preferably 26-30% |
| Moisture at outlet: | 11-19%, preferably 15-17% |
| Mechanical pressure: | 80-250 bar, preferably 80-110 bar. |

The expressions moisture at inlet and moisture at outlet specifically relate to the tobacco material (stems, winnowings, stem fibres, leaf tobacco, etc.).

The processing proposed by the invention preferably results in a product which is a non-continuous tobacco material, in particular a fibrous and/or granular smoking material or smoking article filler material. In other words, the method proposed by the invention results in a product which is ready for consumption and can be used directly in the smoking article. This is very different from producing tobacco film (continuous tobacco material), which is more complex to produce and which still has to be cut and dried after production. The product obtained as a result of this invention is of a size and moisture content which make it suitable for use directly as a filler material for smoking articles.

In one embodiment of the invention, the tobacco fines may be a tobacco dust material. The tobacco dust material may be present in significant quantities without detriment to the capacity of the method proposed by the invention to produce an outstanding product. The proportion of dust (tobacco dust) may even be as high as 100% of the material to be processed without detriment to the success of the method.

For the purpose of the invention, the method may be operated such that the material to be processed may represent a proportion of the tobacco material that is greater than 25%. The material to be processed may also contain a proportion of tobacco fines that is less than 75%.

Yet another positive effect of the method proposed by the invention will be described, which relates to the filling capacity of the end product. During processing, the material to be processed is subjected to an increased mechanical pressure, as explained above. At the end of processing, when the material leaves the processing based on the method as a product, this increased pressure drops again. This usually takes place on discharge from the processing device mentioned above (e.g. extruder, screw conveyor, piston-cylinder unit). The drop in pressure on discharge from this device results in a flash evaporation, thereby causing the material to expand. Depending on the initial filling capacity (as measured under ISO conditions) increases of up to 100% can be achieved. For example, in the case of an initial material with a filling capacity of 1.5 ml/g, the material at the outlet after processing will have a filling capacity of 3 ml/g. In the case of another material, the measured increases in filling capacity were from 1.5 ml/g (initial material) to 4.5 ml/g (material on output, product). As a result of the invention, therefore, materials with a high proportion of fines or dust have filling capacities comparable with those of cut lamina tobacco.

The invention further relates to a smoking article, the smoking material or parts of the smoking material of which are made using a method based on the different embodiments described and explained above.

The invention claimed is:

1. A method for processing tobacco fines to produce a fibrous and/or granular smoking material suitable for use in producing smoking articles comprising, providing a combined tobacco material comprising a quantity of tobacco fines and a quantity of tobacco materials which are bigger than said tobacco fines, pre-conditioning said combined tobacco material by bringing it to a predetermined increase in moisture content, subjecting the pre-conditioned said combined tobacco material to an increased mechanical pressure sufficient to bind the said tobacco fines to the said tobacco material without the need for any addition of an external binding agent, by conveying the pre-conditioned said combined tobacco material continuously through an extruder while simultaneously subjecting the pre-conditioned said combined tobacco material to an increase in temperature whereby said tobacco fines are bound to said tobacco material.

2. The method as claimed in claim 1, wherein said increase in temperature is obtained by applying external heat to the pre-conditioned said combined tobacco material.

3. The method as claimed in claim 1, wherein said tobacco material is a tobacco leaf material, a tobacco stem material, a winnowing material, or a mixture thereof.

4. The method as claimed in claim 1, wherein said tobacco fines are smaller than 1 mm.

5. The method as claimed in claim 1, wherein said tobacco material comprises other additional added tobacco fines.

6. The method as claimed in claim 1, wherein said combined tobacco material does not comprise other additional added tobacco fines.

7. The method as claimed in claim 1, wherein said tobacco fines are bound to said tobacco materials mechanically and/or by binding agents which occur naturally in or are inherent in said tobacco materials.

8. The method as claimed in claim 1, wherein the preconditioned said combined tobacco material is conveyed through said extruder in batches.

9. The method as claimed in claim 1, wherein said combined tobacco material is pre-conditioned to a moisture content of 6-13%.

10. The method as claimed in claim 1, wherein processing of the pre-conditioned said combined tobacco material takes place under at least one of the following conditions:

temperature: 80-180° C.

moisture at extruder inlet: 18-35% moisture at extruder outlet: 11-19% mechanical pressure: 80-250 bar.

11. The method as claimed in claim 1, wherein said combined tobacco material contains a proportion of said tobacco material that is greater than 25%.

12. The method as claimed in claim 1, whereby said combined tobacco material contains a proportion of said tobacco fines that is smaller than 75%.

13. The smoking article containing said smoking material produced by the method as claimed in claim 1.

14. The method as claimed in claim 4, wherein said tobacco fines are smaller than 0.5 mm.

15. The method as claimed in claim 1 wherein said increase in temperature is the result of mechanical pressure as the pre-conditioned said combined tobacco material is conveyed through said extruder.

16. The method as claimed in claim 9 wherein said combined tobacco material is further pre-conditioned to a temperature of 80-147° C.

17. The method as claimed in claim 16 wherein said temperature is 100-120° C.

18. The method as claimed in claim 9 wherein the moisture content of the pre-conditioned said combined tobacco material at the outlet of said extruder is 18-35%.

19. The method as claimed in claim 18 wherein said moisture content at said outlet is 26-30%.

20. The method as claimed in claim 9 wherein said combined tobacco material is further pre-conditioned at a pressure (gas over-pressure) of 0-3 bar.

21. The method as claimed in claim 20 wherein said pressure (gas over-pressure) is 0-1 bar.

22. The method as claimed in claim 10 wherein said temperature is 140-160° C.

23. The method as claimed in claim 10 wherein said moisture at extruder inlet is 26-30%.

24. The method as claimed in claim 10 wherein said moisture at extruder outlet is 15-17%.

25. The method as claimed in claim 10 wherein said mechanical pressure is 80-110 bar.

* * * * *